United States Patent [19]

Kreinbihl et al.

[11] Patent Number: 4,730,355

[45] Date of Patent: Mar. 15, 1988

[54] PNEUMATIC WAVE GENERATOR EMPLOYING FOUR-WAY VALVE ARRANGEMENT

[76] Inventors: Mark L. Kreinbihl, 136 Creston Rd., Mansfield, Ohio 44906; Randall L. Mosher, 833 W. Main St., Loundonville, Ohio 44842; Kevin D. Pramer, 185 Rowland Ave., Mansfield, Ohio 44903; Robert P. Miller, 3643 N. Elyria Rd., Wooster, Ohio 44691

[21] Appl. No.: 861,142

[22] Filed: May 8, 1986 (Under 37 CFR 1.47)

[51] Int. Cl.[4] ..... A47K 3/10

[52] U.S. Cl. ..... 4/491; 405/79; 137/872; 137/883

[58] Field of Search ..... 4/491; 405/79; 137/872, 137/883

[56] References Cited

U.S. PATENT DOCUMENTS

| | | | |
|---|---|---|---|
| 2,624,364 | 1/1953 | Detlefsen | 137/872 X |
| 3,629,877 | 12/1971 | Schuster | 4/491 |
| 4,190,082 | 2/1980 | Hernandez Crespo | 137/872 X |
| 4,276,661 | 7/1981 | Baker | 4/491 |
| 4,467,483 | 8/1984 | Bastenhof | 4/491 |
| 4,506,704 | 3/1985 | Boom et al. | 137/883 |
| 4,515,500 | 5/1985 | Bastenhof | 4/491 X |
| 4,522,535 | 6/1985 | Bastenhof | 4/491 X |
| 4,558,474 | 12/1985 | Bastenhof | 4/491 |

FOREIGN PATENT DOCUMENTS

| | | | |
|---|---|---|---|
| 2572775 | 5/1986 | France | 405/79 |

*Primary Examiner*—Charles E. Phillips

*Attorney, Agent, or Firm*—Weingarten, Schurgin, Gagnebin & Hayes

[57] ABSTRACT

A four-way air directional valve assembly is disclosed in combination with apparatus employed for pneumatically generating waves in a wave pool having a plurality of wave generating chambers arranged side-by-side and extending across the width of a pool at one end thereof. Each of these wave chambers has a below the water passageway in communication with the pool and a sealed portion located above the normal water level of the pool. Each chamber has an inlet-outlet passageway above the water level with the passageway serving in one mode as an inlet for directing forced air into the wave chamber and in a second mode as an outlet for exhausting air therefrom. The air directional valve assembly provides communication between a source of forced air and with associated pair of inlet-outlet passageways communicating with adjacent wave chambers so that the valve assembly can direct air into both chambers simultaneously or direct air into one chamber while exhausting the other chamber or exhaust both chambers while blocking air from the source of forced air.

16 Claims, 14 Drawing Figures

PNEUMATIC WAVE GENERATOR EMPLOYING FOUR-WAY VALVE ARRANGEMENT

BACKGROUND OF THE INVENTION

This invention relates to the art of pneumatic wave generators for use in generating waves in a wave pool.

Pneumatic wave generators are known in the art and are typically employed for creating various wave patterns in a water filled wave pool. Such wave pools have become very popular at water amusement parks and municipal parks in the United States, as well as in foreign countries. They generally comprise a pool having a caisson structure located at one end thereof with the caisson structure being divided into a plurality of wave generating chambers. These chambers are aligned side-by-side across the width of the pool at one end thereof. Each chamber has a below the water passageway in communication with the pool and a sealed portion located above the normal water level of the pool. Forced air, as from a motor driven blower, is directed into various of the chambers forcing water downwardly in the chambers and through the below the water passageway so as to create waves in the pool. Different wave patterns may be created by directing forced air into various combinations of the wave chambers and at various sequences. This is achieved in part by controlling air directing valves located intermediate the source of forced air and the various wave generating chambers. Such valves and associated accessories, including motor driven blowers and the like, operate in timed cycles throughout an operating day which may well be on the order of 12 hours per day for seven days per week over six or more months while the water park is in operation. Consequently, down time for maintenance and repair is of significant concern to water park operators. It is important, then, to minimize the number of moving parts employed for creating the various wave patterns to be used by the water park operator.

The Schuster U.S. Pat. No. 3,629,877 et al. discloses a wave pool having a plurality of wave chambers, together with an air directing valving arrangement for directing air into various of the chambers for creating waves in the pool. The air directing valve arrangement includes a two-way valve device which communicates with a source of forced air and with two adjacent wave generating chambers, each of which has an inlet-outlet passageway for receiving air by way of the valve arrangement or for exhausing air into the surrounding atmosphere or equipment room. The two-way valve arrangement serves in its normal operation to direct air into one of two chambers while exhausting air from the other chamber. This arrangement does not provide for forcing air into both chambers simultaneously. This, then, limits the combinations of wave patterns that may be generated by such a valve arrangement.

Another form of pneumatic wave generator known in the prior art takes the form as illustrated in the D. Bastenhof U.S. Pat. Nos. 4,467,483 and 4,558,474. The wave generator systems disclosed in the Bastenhof patents include a separate valve arrangement for each wave generating chamber for communicating air from a source of forced air into wave generating chamber. Each chamber has a dedicated inlet passage and a dedicated outlet passage. The valve arrangement for each chamber includes an inlet valve and an outlet valve with a common drive therebetween so that whenever the inlet valve is closed, the outlet valve is open and vice versa. This, then, presents a substantial amount of equipment and moving parts as opposed to the two-way valve arrangement of Schuster, supra, which is employed in conjunction with directing air into and out of two adjacent chambers.

SUMMARY OF THE INVENTION

A principal object of the present invention is to provide a valve arrangement for use with two wave generating chambers each having an inlet-outlet passageway with the valve arrangement having four modes of operation so that it can direct air into both of the chambers simultaneously, or direct air into one of the chambers while exhausting the other chamber or exhaust both chambers while blocking air from the source of forced air.

It is a still further object of the present invention to provide an improved wave generator apparatus for use in a wave pool which minimizes the number of moving parts and related equipment so as to minimize the cost of installation, as well as maintenance, while still providing equipment capable of generating a wide variety of wave patterns, including both V and inverted V patterns, diagonal patterns, diamond patterns and parallel patterns, as well as others.

It is a still further object of the present invention to provide an improved wave generator apparatus including a four-way valve arrangement which may be employed in retrofitting prior art wave generating systems.

In accordance with the present invention, apparatus is provided for pneumatically generating waves in a wave pool having water therein and wherein the wave pool employs a plurality of wave generating chambers arranged side-by-side and extending across the width of the pool at one end thereof. It is further contemplated that each chamber has a below the water passageway in communication with the pool together with a sealed portion extending above the normal water level of the pool and that each chamber has an inlet-outlet passageway, which in one mode serves as an inlet for receiving forced air and in a second mode serves as an outlet for exhausting air from a chamber. A source of forced air is provided together with valving means which communicates with the source as well as with first and second inlet-outlet passageways respectively associated with first and second wave generating chambers. This valve means has four conditions. A first condition provides for simultaneous air flow from the source into both the first and second chambers. In a second condition, air flow is provided into a first chamber while exhausting the second chamber. In a third condition, the air flow is supplied into the second chamber while exhausting the first chamber. In a fourth condition, air flow is blocked from the source while air is exhausted from both the first and second chambers.

BRIEF DESCRIPTION OF THE DRAWINGS

The foregoing and other objects and advantages of the invention will become more readily apparent from the following description of the preferred embodiment of the invention as taken in conjunction with the accompanying drawings which are a part hereof and wherein.

DETAILED DESCRIPTION OF PREFERRED EMBODIMENTS

Figure 1:
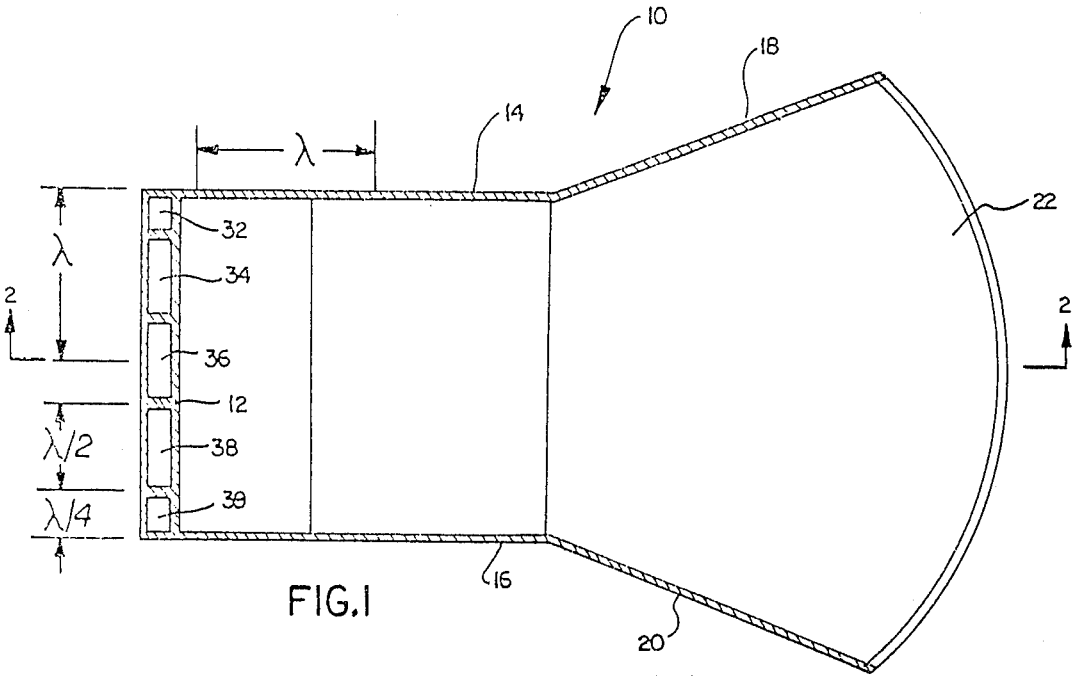
FIG. 1 is a plan view taken along line 1—1 looking in the direction of the arrows in FIG. 2 of a wave pool employing the invention.
Figure 2:
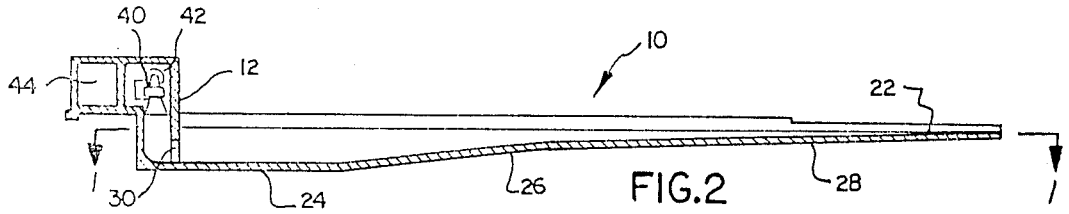
FIG. 2 is a longitudinal sectional view taken along line 2—2 looking in the direction of the arrows in FIG. 1.
Figure 5:
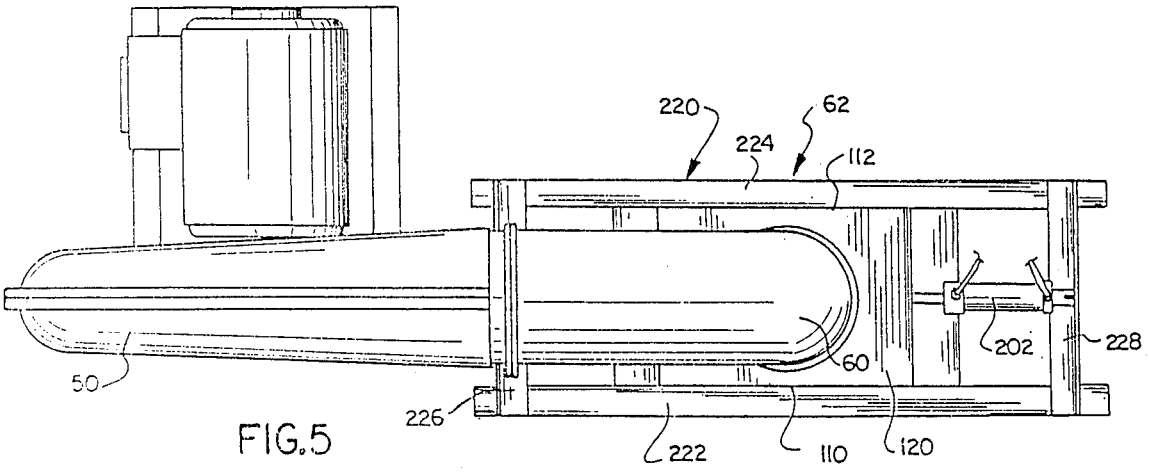
FIG. 5 is a view taken along line 5—5 looking in the direction of the arrows in FIG. 4.

Reference is now made to the drawings wherein the showings are for purposes of illustrating preferred embodiments of the invention only and not for purposes of limiting the same. FIGS. 1 and 2 illustrate a wave pool of the type to which the present invention may be applied. Here, there is illustrated a pool 10 which may be constructed of concrete or the like and which has a deep end wall 12 with side walls 14 and 16 which respectively diverge outwardly as side wall extensions 18 and 20 to establish a beach area 22. The wave pool has a bottom wall 24, an upwardly sloping wall 26 and a beach bottom floor 28. As an example, the width of the pool at the deep end wall 12 may have be on the order of 82 feet and the total length of the pool from the deep wall to the beach area may be on the length of 180 feet. The depth of the pool adjacent the deep end wall 12 may be on the order of 11 feet with the water level being on the order of 8 feet as measured from the bottom wall 24.

The deep end wall 12 does not extend to the bottom wall 24 but stops short thereof leaving underwater passageways 30 which provide communication between the pool and each of a plurality of wave chambers 32, 34, 36, 38 and 39 which extend across the width of the pool at the deep end thereof. In a quiescent state, each of these chambers contains water communicating with the pool by way of the underwater passageways 30, the water level in the chambers being at the same level as that in the pool. A space is provided in each chamber above the water level for receiving forced air from an air source which takes the form of one or more motor driven air blowers 40 located in a blower room 42. The blower room 42 may be at the same level as that of the wave chambers or may be located above the wave chambers, as is illustrated in FIG. 2. Additionally, in FIG. 2 an equipment room 44 is located behind the blower room and this may house auxiliary equipment associated with the operation of the wave pool. Having now briefly described an application of the invention, attention is directed to FIGS. 3 and 4 which provide a more detailed illustration of a wave pool having wave generating equipment.

Figure 4:
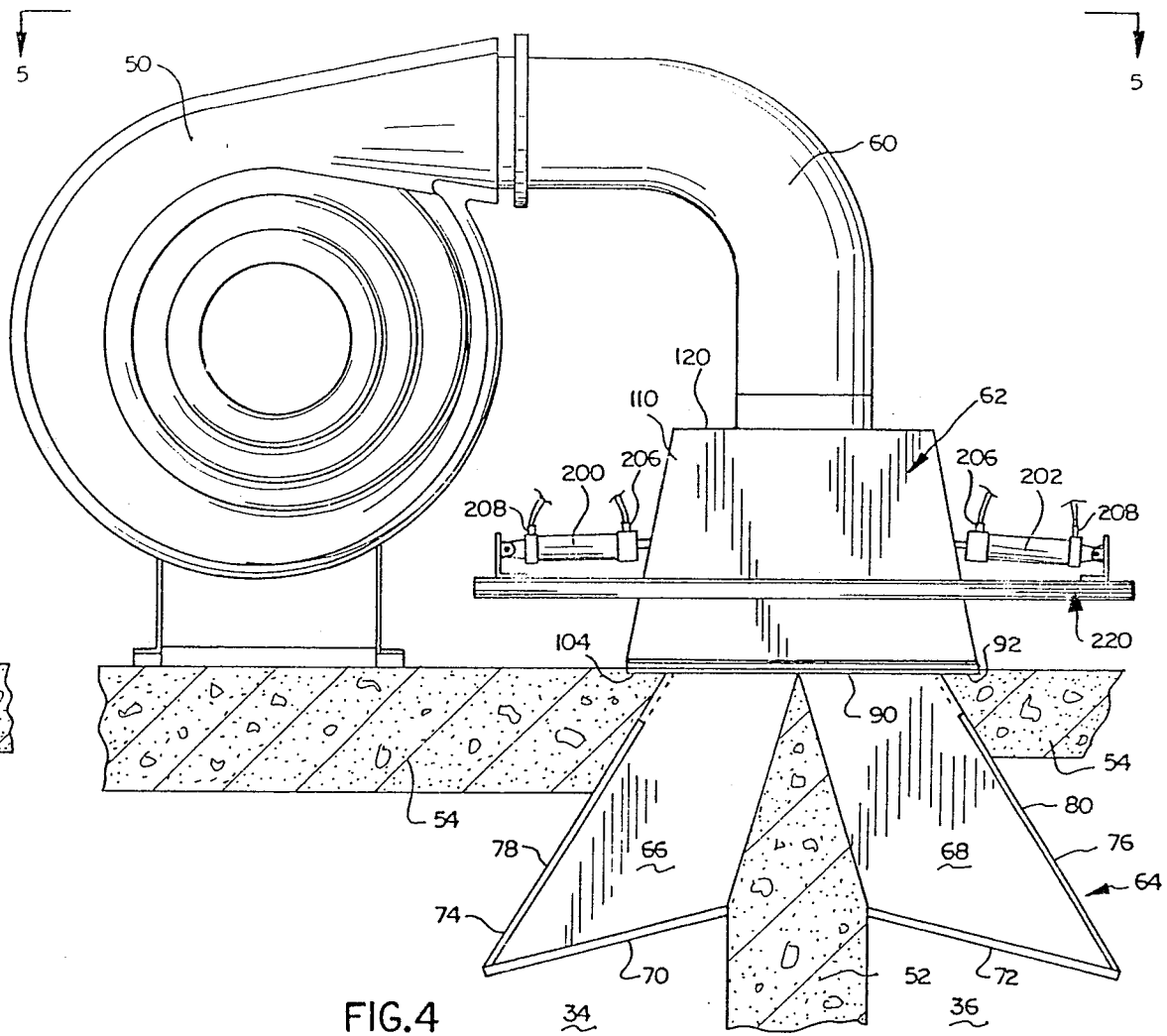
FIG. 4 is a view taken along line 4—4 looking in the direction of the arrows in FIG. 3.
Figure 3:
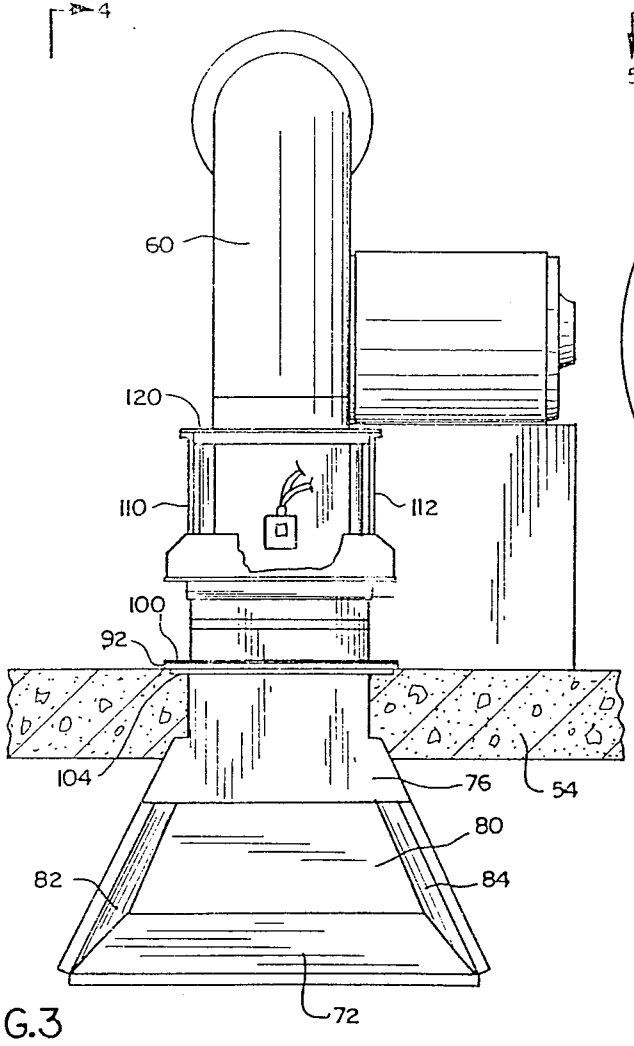
FIG. 3 is an enlarged view showing an application of the invention.

In the embodiment illustrated in FIGS. 3 and 4, an electrically driven blower 50 is mounted above a pair of associated side-by-side wave chambers 34 and 36 and, hence, this arrangement may be referred to as a top mounted wave generator system. These two chambers, as seen in FIGS. 3 and 4, are separated by a common wall 52 extending upwardly from the bottom wall 24 and covered with a roof 54. The rear of the water chamber and blower room 40 is defined by an upstanding wall extending from the pool bottom 24 in a vertically upward direction parallel to that of the deep end wall 12 which together terminate in a lid, which covers the blower room 40.

In the embodiment of FIGS. 3 and 4, it is contemplated that a motor driven blower, such as blower 50, will supply forced air into two adjacent wave generating chambers, such as chambers 34 and 36. The blower is in communication with these chambers by way of a hose 60 which is coupled to the outlet of the blower and thence to an air directional valve apparatus 62, to be described in greater detail hereinafter, which then directs air into one or both of the chambers by means of a caisson sleeve 64. The caisson sleeve 64 is constructed of sheet metal, such as stainless steel, and is mounted in the concrete walls 52 and 54, as viewed in FIGS. 3 and 4, providing two conduits, each defining an inlet-outlet passageway for air to be forced into or evacuated from an associated one of the chambers 34 and 36. These inlet-outlet passageways 66 and 68 and the two chambers 34 and 36, respectively, are illustrated in FIGS. 3 and 4. The caisson sleeve 64 includes bottom walls 70 and 72 which prevent water from splashing up into passageways 66 and 68. Outwardly diverging side walls 74 and 76 are located in chambers 34 and 36, respectively. These walls are provided with openings 78 and 80 which respectively provide air communication from the valve assembly 62 into or out of the chambers 34 and 36. Opening 80 in side wall 76 is best illustrated in FIG. 3. From FIG. 3, it will be noted that caisson sleeves also have outwardly diverging side walls 82 and 84 so that air being received from the blower by way of the air directional assembly 62 is directed into the chamber only by way of opening 80 in the wall 76.

The inlet-outlet passageways 66, 68 are formed by adjacent openings through wall 54 leading into adjacent wave chambers 34, 36. These openings are divided by a tapered portion of wall 52 so that at the upper surface of wall 54 a common rectangular opening 90 is defined. A foam air seal 92, taking the form of a rectangular gasket having an opening therein the size of opening 90, is preferably placed around the peripheral edge of opening 90 on the upper surface of wall 54 so as to form an air tight seal with the air directional valve assembly 62. This is best illustrated in FIGS. 4 and 6.

Figure 6:
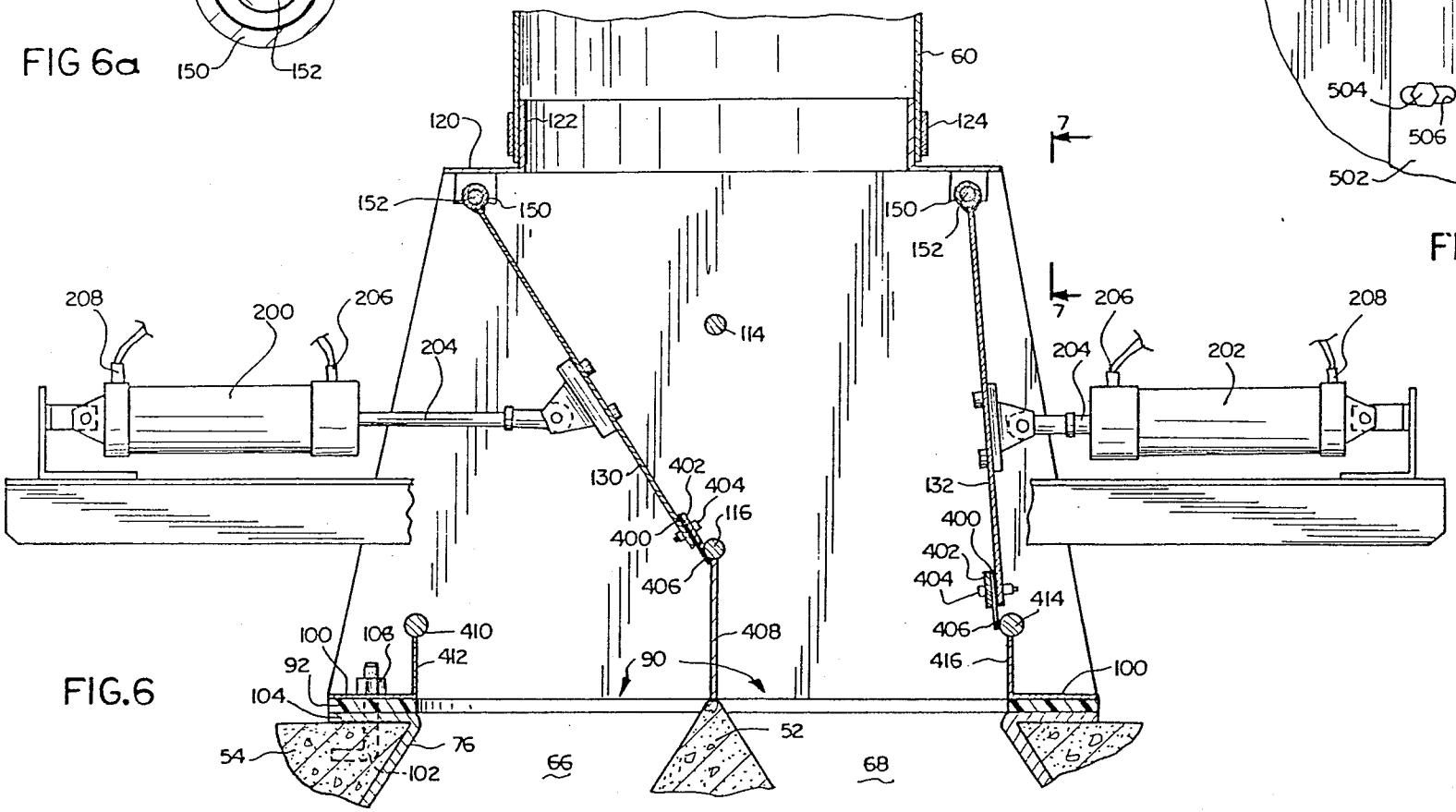
FIG. 6 is a sectional view with parts broken away of the valve assembly.
Figure 6A:
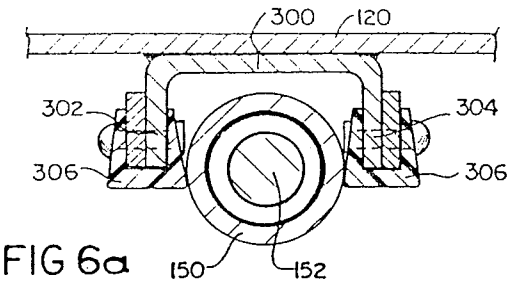
FIG. 6A is an enlarged view showing a sealing arrangement.

The air directional valve assembly 62 is mounted over the opening 90 so that horizontally outwardly extending bottom flanges 100 of the assembly overlie the gasket 92 (see FIG. 6). The valve assembly may be anchored in place as with an anchor bolt 102 which is anchored into the concrete wall 54 and which extends through a horizontally extending rim 104, extending outwardly from the caisson sleeve 64, and, thence, through the gasket 92 and the peripheral flange 100 of the valve assembly and held in place as with a nut 106 threaded to the end of the anchor bolt 102.

The air directional valve assembly 62 includes upstanding side walls 110 and 112 which are separated from each other and held in place by means of horizontally extending support bars 114 and 116 (FIG. 6) which are welded at opposite ends to the side walls 110 and 112. These side walls 110 and 112 are also separated and held in place by means of a valve assembly roof 120 which is welded to the side walls. The roof has a circular opening bounded by an upstanding vertical sleeve 122. This sleeve may be on the order of slightly less than 16 inches in diameter so as to receive hose 60 which has an internal diameter on the order of 16 inches. With the hose being mounted on the external periphery of sleeve 122, it is then clamped in place by means of a band clamp 124 so as to provide an air tight seal therebetween. The hose 60 preferably takes the form of a metal spiral coil reinforced flexible hose of nylon fabric and which is preferably covered with neoprene.

Figure 7:
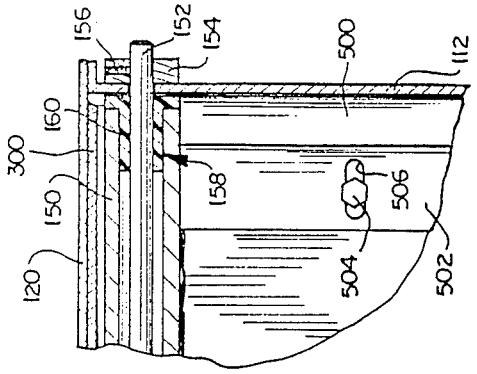
FIG. 7 is an enlarged sectional view showing a pivot arrangement.

The ends of the valve assembly are sealed off by means of end flaps 130 and 132 pivotally mounted at their upper ends to the assembly. Each flap is a relatively flat stock of sheet metal, such as stainless steel, of rectangular shape extended transversely between side walls 110 and 112. Each of the end flaps 130, 132 is pivotally mounted at its upper end to the valve assembly structure. Each flap has its upper edge welded to an elongated cylindrical sleeve or pipe 150 which coaxially surrounds a stationary rod 152 which extends between the side walls 110 and 112 and is journalled therein. As is best shown in FIG. 7., the opposing ends of each rod 152 extend through the side walls 110 and 112 and are secured there in place by means of an axial boss 154 which is secured in place as with a cotter pin 156. Additionally, each end of rod 152 carries a bearing 158 on the inner side of the side walls and having a shank portion 160 located intermediate rod 152 and the encircling pipe 150 so as to provide a bearing so that the pipe 150 may pivot about the rod 152. This flap, then, pivots in this structure between a valve open position, as in the case of end flap 132 as viewed in FIG. 6, and a valve closed position, as indicated by end flap 130 in FIG. 6. The pivotal angle for each flap is on the order of 38° between a closed position and an open position.

The end flaps 130 and 132 are respectively driven between the open and closed positions by pneumatic cylinders 200 and 202, respectively. These are conventional in the art and each includes a piston located internally of the cylinder and a plunger bar 204 which is driven by the piston between a retracted position and an extended position. Thus, when pressurized air is supplied into a retract inlet 206, the piston and hence the plunger rod is driven to a retracted position. When pressurized air is supplied into an extend inlet 208, the piston and hence the plunger rod 204 is driven to the extended position. As best seen in FIG. 6, each plunger rod 204 is mechanically and pivotally connected one of the flaps 130 and 132 for driving the associated flap between its open and closed positions.

The pneumatic cylinders 200 and 202 are carried by a frame 220 that encircles the valve assembly 62. The frame 220 includes horizontally extending side rails 222 and 224 which extend along the exterior of valve assembly side walls 110 and 112, respectively, and are welded thereto. The ends of the side rails 222 and 224 are interconnected by means of end rails 226 and 228. The pneumatic cylinders 200 and 202 are mounted to the end rails 226 and 228, respectively.

The end flaps 130 and 132 are provided with sealing arrangements so as to provide an air tight seal along the peripheral edges. One such arrangement is in conjunction with the pivotal mounting structure. As best seen in FIG. 6, this air tight seal includes an inverted U-shaped bracket 300 having downwardly extending legs 302 and 304 which straddle each of the pipes 150 welded to the upper edge of flaps 130 and 132. The U-shaped bracket extends between side walls 110 and 112 and is suitably secured to the roof 120, as by welding. Each of the downwardly extending legs 302 and 304 carries a sealing element 306. Each sealing element 306 takes the form of a elongated U-shaped member having legs which straddle the associated leg 302 or 304 of bracket 300 and extends transversely between side walls 110 and 112. The sealing elements 306 are secured to the legs 302 and 304 by suitable means, such as with rivets. The sealing elements straddle an associated pipe 150 and bear against the pipe as the pipe pivots between a flap open position and a flap closed position. These sealing elements serve as wear surfaces and also act as bearing surfaces for the pipe to prevent air leakage during operation. Preferably, each of the sealing elements 306 is constructed from ultra high molecular weight polyethelyne (UHMW) material. This, then, provides an air tight pivot arrangement at the upper ends of flaps 130 and 132.

The bottom edge of each flap 130 and 132 is also provided with sealing means for providing an air tight seal when the flap is in its closed position or in its open position. As shown with respect to end flap 130, the seal means includes an elongated rubber seal 400 which extends across the width of the flap between side walls 110 and 112 and is held in place on the flap by means of a keeper clamp 402 and suitable nut and bolt arrangements 404 which secure the rubber seal 400 and keeper clamp in place on the lower end of flap 130. The rubber seal 400 has a tongue portion 406 which extends beyond the lower edge of flap 130. This tongue portion 406 serves to resiliently bear against and provide an air tight seal with pipe 116 when the flap is in its closed position. The pipe 116 extends between side walls 110 and 112 and is welded to the upper edge of a divider wall 408 which also extends between side walls 110 and 112. The lower end of the divider wall 408 is designed to rest upon the upper pointed edge of the divider wall 52 which divides wave chambers 34 and 36. This, then, provides a seal which prevents forced air from entering into chamber 34 when flap 130 is in its closed condition, as is shown by the solid lines in FIG. 6. When flap 130 is pivoted to its open position, tongue portion 406 resiliently bears against a pipe 410 which extends between side walls 110 and 112 and which is welded to an upstanding flange 412 which also extends between side walls 110 and 112.

A similar seal is also provided on the lower edge of flap 132 and like character references are employed for like components. The tongue portion 406 of the seal mounted on flap 132 provides an air tight seal by resiliently bearing against pipe 116 when the flap is in its closed position and also provides an air tight seal when the flap is in its closed position during which the tongue portion 406 resiliently bears against a pipe 414 which extends between side walls 110 and 112. Pipe 414 is carried by and is welded to the upper edge of an upstanding flange 416 which also extends between side walls 110 and 112.

In addition to the upper and lower edges of the flaps being provided with sealing means for providing air tight operation, each flap is also provided with sealing means along its peripheral side edges for providing air tight seals with the inner surface of side walls 110 and 112 as the flaps are pivoted between their open and closed positions. Each of these peripheral side edge seals takes the form as best seen in FIG. 7 which is an end view with parts broken away showing the flap 130. The sealing means includes an elongated sealing strip 500 which appears in cross section like the U-shaped sealing elements 302 and 304 illustrated in FIG. 6. This U-shaped sealing strip 500 is mounted so that its legs straddle the edge of an elongated seal plate 502 so as to extend for the vertical distance of the flap. The seal element 500 is rivoted on otherwise secured to the seal plate 502 which, in turn, is bolted onto the flap by means of suitable bolts 504. These bolts extend through horizontally elongated slots 506 (as viewed in FIG. 7) so that the seal plate 502 may be adjusted transversely toward or away from a side wall, such as side wall 112, to effect an adjustable sealing arrangement. Whereas this seal is illustrated only with respect to the right edge of flap 132 as viewed in FIG. 7, it is to be understood that an identical transversely adjustable seal is provided on the left edge and that identical adjustable seals are provided on the left and right edge of flap 130.

Figure 8A:
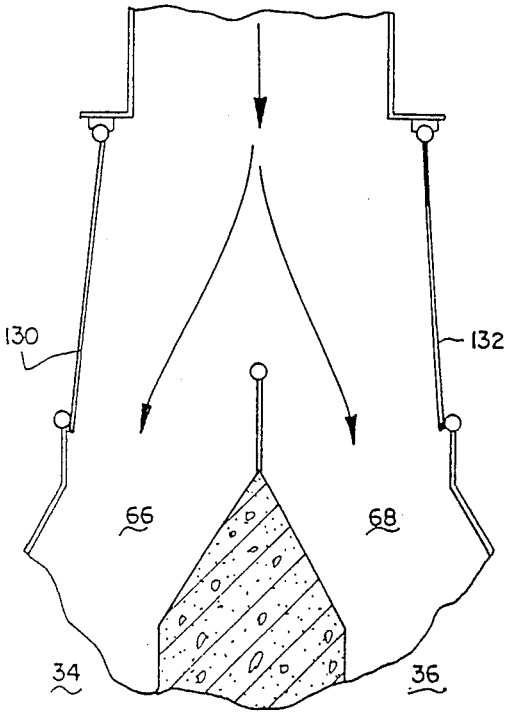
FIGS. 8A–8D are schematic illustrations of the valve assembly operation.
Figure 8B:
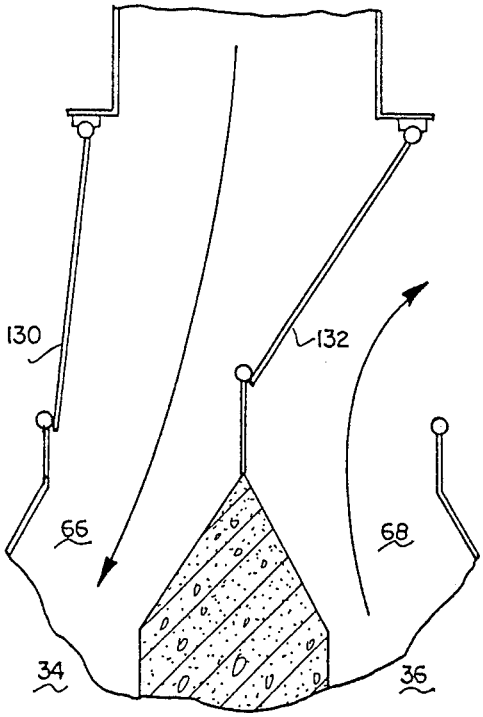
Figure 8C:
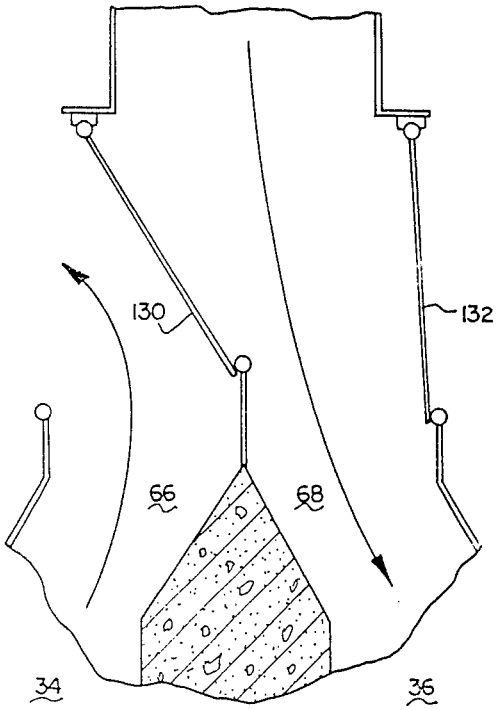
Figure 8D:
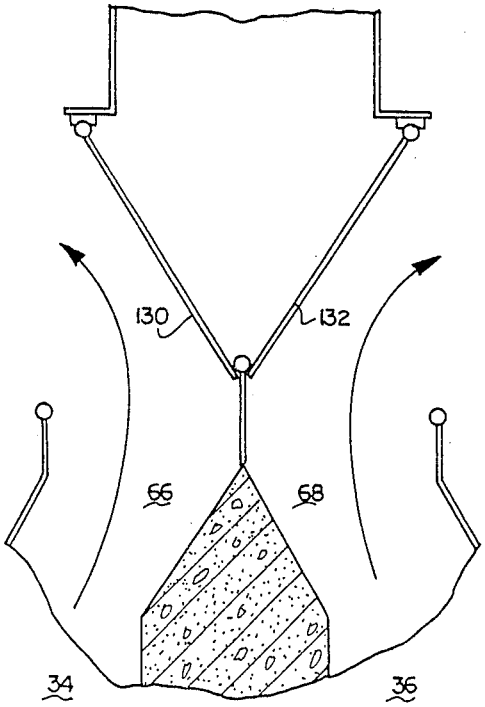

From the foregoing, then, it is seen that flaps 130 and 132 are provided with air tight seals along all four peripheral edges to prevent air leakage as air is being forced into one or both and/or exhausted from one or both of the wave chambers 34 and 36. The four modes of operation of the air directional valve assembly 62 are illustrated in FIGS. 8A–8D. In FIG. 8A, forced air is directed from the blower into the valve assembly and thence into both wave chambers 34 and 36, since both flaps 130 and 132 are in the open position. In FIG. 8B, flap 130 is in its open position, whereas flap 132 is in its closed position so that forced air is directed into chamber 34, while air is exhausted from chamber 36 through the inlet-outlet opening 68. In a third mode of operation, as illustrated in FIG. 8C, flap 130 is in a closed condition, whereas flap 132 is in an open position so that air is exhausted from chamber 34 while simultaneously thereto forced air is directed into chamber 36. The fourth mode of operation is schematically illustrated in FIG. 8D where both flaps 130 and 132 are in their closed positions so that air may be simultaneously exhausted from both chambers 34 and 36. The sealing arrangements around the peripheral edges of flaps 130 and 132 provide for efficiency of operation with minimal loss of air during these four different modes of operation.

In the embodiment of the invention as illustrated in FIGS. 3 and 4, the air directional valve assembly 62 is directly connected to a single blower 50 by means of the flexible hose 60 for selectively directing air into one or both of a pair of side-by-side wave chambers 34 and 36. In this embodiment, the valve assembly 62 is located in what may be termed a top mounted arrangement in which the source of air is located above the wave chambers and air is directed downwardly into the air chambers. It is to be appreciated that the valve assembly 62 may be employed in different arrangements than that shown in FIGS. 3 and 4. For example, the air directional valve assembly could be mounted in what may be termed a side mounted arrangement wherein air is directed into adjacent wave chambers from one side rather than the top mounted arrangement of FIGS. 3 and 4. Additionally, each air directional valve assembly need not be directly connected with a single blower, such as illustrated in FIGS. 3 and 4. Instead, an arrangement may be obtained in which there are fewer blowers than there are directional valve assemblies. This can be achieved, for example, with a common plenum.

Figure 9:
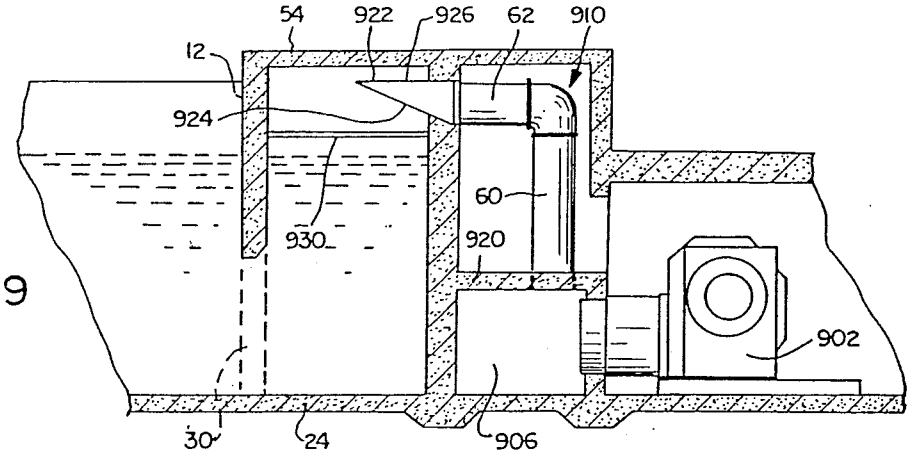
FIG. 9 is a sectional elevational view of a second application of the invention.
Figure 10:
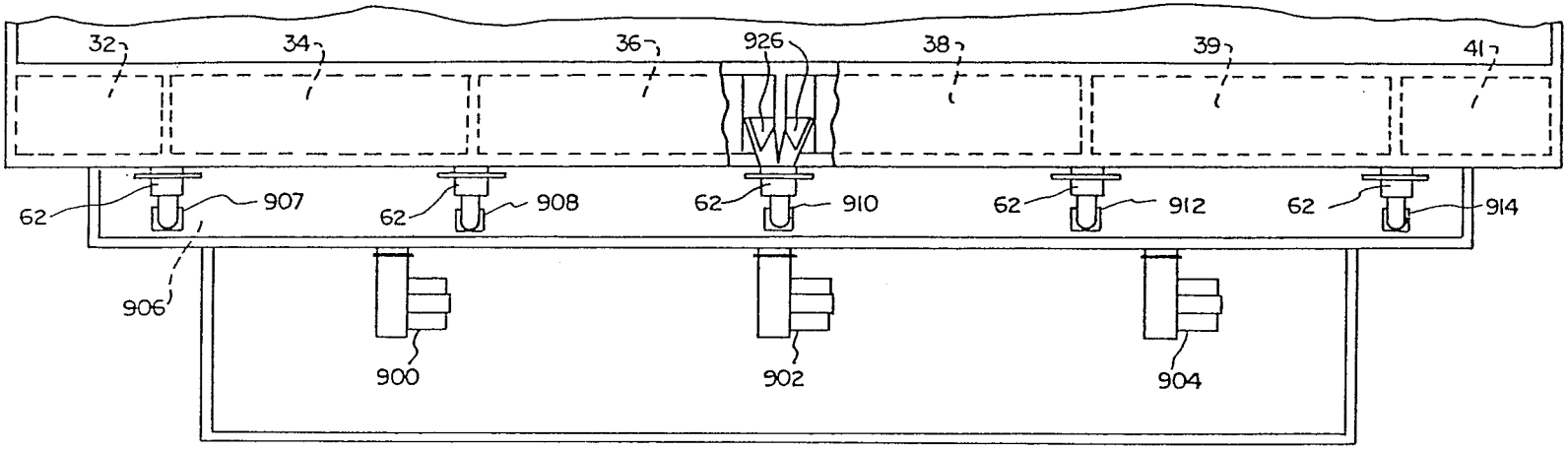
FIG. 10 is a plan view of that illustrated in FIG. 9.

Reference is now made to FIGS. 9 and 10 which illustrate some of these features with a different mounting arrangement of the air directional valve assembly. To facilitate the description of the embodiments of FIGS. 9 and 10, similar character references are employed for identifying similar components to that discussed hereinbefore. In this embodiment, there are provided six wave chambers 32, 34, 36, 38, 39 and 41, rather than the five chambers described in conjunction with FIGS. 1 and 2. The end chambers 32 and 41 are half chambers in that they may be on the order of 10 feet wide whereas the remaining chambers maybe on the order of 20 feet wide. Forced air is provided by three motor driven blowers 900, 902 and 904 which direct air into a common plenum 906 which, in turn, communicates with the six wave chambers by means of five spaced apart valve ducting arrangement 907, 908, 910, 912 and 914. Each of these ducting arrangements incorporates an air directional valve assembly 62 constructed in the manner as described hereinbefore except that each is a side mounted arrangement, as is best seen in FIG. 9. Each ducting arrangement, such as arrangement 910 illustrated in FIG. 9, incorporates a flexible hose 60 in communication with a common plenum 906 by way of an aperture through the plenum roof 920. Air is directed into two adjacent water chambers, such as chambers 36 and 38, by means of the caisson sleeve 922 constructed similar to the caisson sleeve 64 illustrated in FIGS. 3 and 4. The bottom wall 924 of the caisson sleeve is canted relative to the horizontal and air being directed into the wave chambers enters by way of an opening 926 in the upper wall of the caisson sleeve. A splash guard 930 is located underneath each caisson sleeve and immediately above the normal water level for preventing water from splashing up and into the air directional valve assembly.

The embodiment illustrated in FIGS. 9 and 10 operates in the same manner as that discussed hereinbefore, and the four modes of operation of the air directional valve assemblies 62 are that as illustrated in FIGS. 8A–8D.

Although the invention has been described in conjunction with preferred embodiments, it is to be understood that various modifications may be made without departing from the spirit and scope of the invention as defined by the appended claims.

Having described specific preferred embodiments of the invention, the following is claimed:

1. Apparatus for pneumatically generating waves in a wave pool having water therein, said wave pool having a plurality of wave generating chambers arranged side-by-side extending across said pool at one end thereof wherein each said wave chamber has a below the water passageway in communication with said pool and a sealed portion located above the normal water level of said pool, each said chamber having an inlet-outlet passageway above said water level, said passageway serving in one mode as an inlet for receiving forced air and in the second mode as an outlet for exhausting air from a said chamber, said apparatus comprising:

a source of forced air; and valve means communicating with said source and with first and second said inlet-outlet passageways respectively associated with first and second wave generating chambers, said valve means having a first condition for simultaneously providing air flow from said source into both of said first and second chambers, a second condition for providing air flow into said first chamber while exhausting said second chamber, a third condition for providing air flow into said second chamber while exhausting said first chamber, and a fourth condition for blocking air flow from said source while exhausting both said first and second chambers.

2. Apparatus as set forth in claim 1 including a plurality of said valve means each communicating with a said source of forced air and with a pair of said inlet-outlet passageways associated with different wave chambers so that all of said wave chambers are in communication with a said source of air by way of a said valve means so that air may be selectively directed into or exhausted from all of said chambers.

3. Apparatus as set forth in claim 2 wherein said source of forced air includes a single motor driven blower in communication with each valve means such that the number of motor driven blowers is less than the number of wave generating chambers.

4. Apparatus as set forth in claim 2 wherein said source of forced air includes a common plenum and means interconnecting said common plenum with each of said valve means and at least one motor driven blower means in communication with said common plenum for directing forced air into said common plenum.

5. Apparatus as set forth in claim 4 including a plurality of motor driven motor means of a number less than the number of said wave generating chambers.

6. Apparatus as set forth in claim 5 wherein the number of said motor driven blowers is less than the number of said valve means.

7. Apparatus as set forth in claim 1 wherein said valve means has first and second movable valve members respectively associated with said first and second inlet-outlet passageways, each said valve member having an open position and a closed position with respect to its associated inlet-outlet passageway, and means for selectively displacing each said valve member between its open and closed positions such that when a said valve member is in its open position its associated inlet-outlet passageway operates as a said inlet passageway and when the said valve member is in its closed position its associated inlet-outlet passageway operates as a said outlet passageway.

8. Apparatus as set forth in claim 7 wherein said valve member displacing means includes first and second actuatable valve displacing means for respectively displacing said first and second valve members between said open and closed positions.

9. Apparatus as set forth in claim 1 including an air directional valve assembly containing said valve means and including a pair of side walls, a roof extending between said side walls with said roof having an opening therein for connection with a said source of forced air and wherein said valve means includes first and second end flaps each extending between said side walls and being pivotally mounted to said assembly for pivotal movement about an axis extending between said side walls.

10. Apparatus as set forth in claim 9 wherein each of said end flaps is pivotally movable about its pivot axis between a valve closed position and a valve open position.

11. Apparatus as set forth in claim 10 including sealing means for sealing the peripheral edges of each of said flaps when in a valve open position or in a valve closed position.

12. Apparatus as set forth in claim 11 including means for adjusting the positioning of each said side edge sealing means transversely of said side walls.

13. Apparatus as set forth in claim 11 wherein each of said flaps has a side edge located adjacent one of said side walls and said sealing means includes a sealing member extending along said side edge for making sealing engagement with a said side wall to provide an air tight seal therewith.

14. Apparatus as set forth in claim 13 wherein each said flap has a lower peripheral edge and an upper peripheral edge extending between said side edges, sealing means mounted on the said flap adjacent the lower peripheral edge thereof and extending therebeyond for use in making sealing engagement with cooperating members extending between said side walls, and a plurality of cooperating members extending between said side walls for making sealing engagement with said sealing members in said flap open and flap closed positions.

15. Apparatus as set forth in claim 14 wherein the upper peripheral edge of a said flap is connected to a pivot member which extends transversely between and is journalled in said side walls.

16. Apparatus as set forth in claim 15 including means for providing an air tight seal for said upper edge as said flap pivots between said flap open and flap closed positions.

* * * * *